US006749041B1

(12) United States Patent
Hutchings et al.

(10) Patent No.: US 6,749,041 B1
(45) Date of Patent: Jun. 15, 2004

(54) JOIST SCAFFOLD UNIT

(76) Inventors: Larry S. Hutchings, 1015 250th St., Emerson, IA (US) 51533; Wendy J. Hutchings, 1015 250th St., Emerson, IA (US) 51533

( * ) Notice: Subject to any disclaimer, the term of this patent is extended or adjusted under 35 U.S.C. 154(b) by 0 days.

(21) Appl. No.: 10/326,949

(22) Filed: Dec. 23, 2002

(51) Int. Cl.[7] ..... E04G 1/36
(52) U.S. Cl. ..... 182/45
(58) Field of Search ..... 182/45, 169, 165, 182/170, 168, 107, 214, 171

(56) References Cited

U.S. PATENT DOCUMENTS 1,376,924 A 5/1921 Dixson
1,474,250 A 11/1923 Folliord
1,841,676 A 1/1932 Roberts
3,508,628 A * 4/1970 Conrad ..... 182/172
3,628,628 A 12/1971 Gilbrect
3,917,214 A 11/1975 Ratcliff
4,531,613 A 7/1985 Keigher
4,858,726 A 8/1989 Preston
5,114,024 A 5/1992 Meissner
6,073,726 A * 6/2000 McCrystal ..... 182/195

* cited by examiner

*Primary Examiner*—Hugh B. Thompson, II
(74) *Attorney, Agent, or Firm*—Richard L. Mikesell

(57) ABSTRACT

A joist scaffold unit including first and second vertical legs of adjustable length disposed generally parallel to one another. Horizontal crossbars of adjustable length extend between the first and second legs. A foot is pivotally attached to the bottom end of each leg and configured to be secured to a ceiling or floor joist. A vertical brace extends from the leg or the crossbar at an angle to the ceiling or floor joist. A foot at the end thereof is configured to be secured to the ceiling or floor joist. A supporting structure is placed over spaced-apart of joist scaffold units to allow construction workers to work on a roof or the like.

7 Claims, 1 Drawing Sheet

FIG. 1
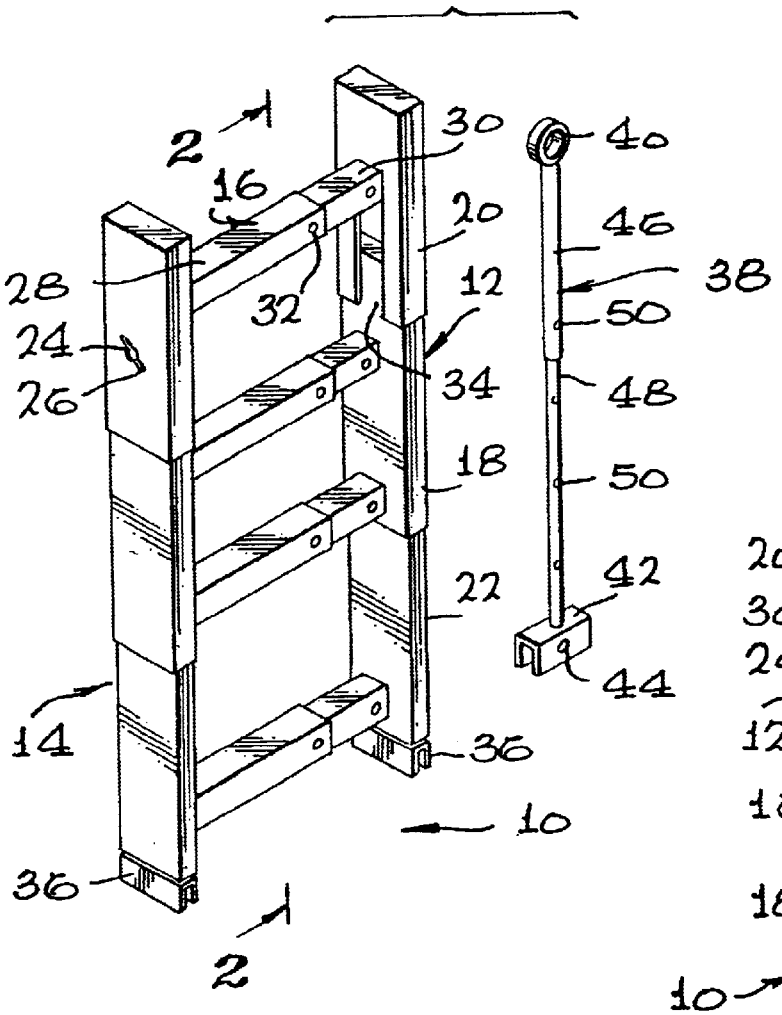
FIG. 2
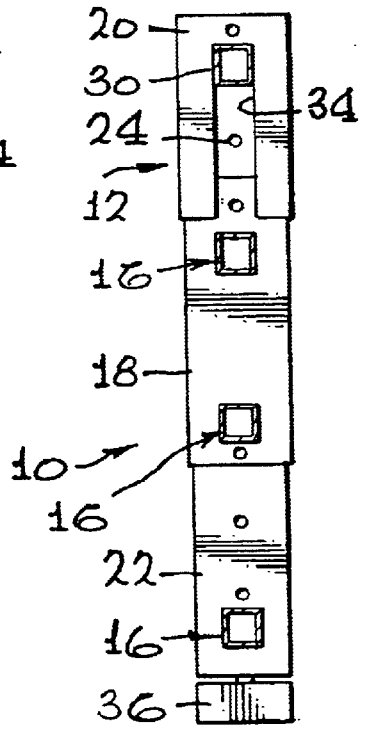
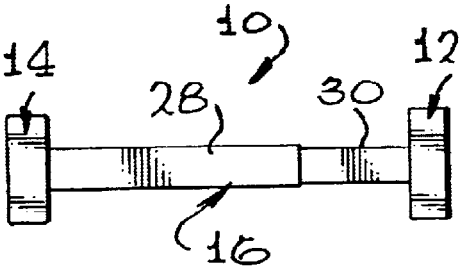
FIG. 3

JOIST SCAFFOLD UNIT

BACKGROUND OF THE INVENTION

The present invention generally relates to scaffolding used in building construction and the like. More particularly, the present invention resides in a scaffold unit which is attachable to joists of a floor or ceiling to facilitate repairs and construction of a roof or ceiling.

The use of scaffolding in the construction industry is well known. For example, scaffolding may be constructed on an exterior of a building to facilitate plaster or paint work. Traditionally, scaffolding has been constructed of frame members which are assembled and placed a set distance apart from one another on a flat surface, such as the ground or a floor. Planks are laid across the assemblies in order to allow construction workers and the like to be elevated to the working area.

However, such scaffolding has certain disadvantages. For example, the end metal units are typically non-adjustable in height. Adjustability is provided by stacking scaffolding units upon one another, or selecting a scaffolding which meets the requirements of the user. Also, when constructing a roof, it is common to have ceiling or floor joists underlying the ceiling during the framing and construction process. This presents a challenge for traditional scaffolding.

Accordingly, there is a continuing need for a scaffolding structure which is particularly suited for the construction and repair of roofs and ceilings when floor or ceiling joists are positioned below the intended work area. Such a scaffolding structure should preferably be adjustable in width and height so as to accommodate the needs of the construction worker. The present invention fulfills these needs and provides other related advantages.

SUMMARY OF THE INVENTION

The present invention resides in a joist scaffold unit which is particularly designed for use on floor or ceiling joists, which typically comprise wood beams running parallel to one another to create the supporting structure for the floor or ceiling. The joist scaffold unit generally comprises first and second vertical legs of adjustable length disposed generally parallel to one another. Horizontal crossbars of adjustable length extend between the first and second legs. A foot is pivotally attached to a bottom of each leg, so as to be secured to the floor or ceiling joist. The foot includes a generally U-shaped bracket configured to receive an edge portion of a joist therein.

Each leg comprises a main body having a first end telescopically and slidably received within an upper riser. A second, lower end of the main body is telescopically and slidably received within a lower riser. Thus, the legs can be adjusted in height. The main body and upper and lower risers have alignable adjustment apertures for receipt of a locking pin or the like to fix the legs at the desired height. Each crossbar is comprised of a tubular first segment which telescopically and slidably receives a second segment extending from the opposite leg. The first and second segments include alignable adjustment apertures for receipt of a locking pin therethrough to fix the width of the legs so that the feet can be properly positioned over the floor joists.

A brace of adjustable length extends from the leg or the crossbar of the scaffold at an angle towards the floor joist. A foot which is pivotally attached at an opposite end of the brace is configured to be secured to the ceiling or floor joist.

Such foot includes a generally U-shaped bracket configured to receive an exposed portion of the joist, and preferably includes a fastener extendable through the foot and into contact with joist to securely connect the foot thereto. The brace is preferably comprised of a first tube that telescopically and slidably receives a second tube so as to be adjustable in length. The first and second tubes include a linable adjustment apertures for receipt of a locking pin therethrough to lock the brace at the desired length.

In use, one joist scaffold unit is secured to floor or ceiling joists, and a second is secured to floor or ceiling joists and spaced from the first joist scaffold unit. Planks or the like are then placed over the upper most crossbars to provide a supporting surface for the construction workers to be elevated with respect to the floor ceiling joists and work on the roof above.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 1 is a partially exploded perspective view of a scaffolding unit embodying the present invention;

FIG. 2 is a cross-sectional view taken generally along line A—A of FIG. 1, illustrating the adjustable nature of legs of the scaffolding unit; and FIG. 3 is a top plan view of the leg and crossbar unit of the invention.

DETAILED DESCRIPTION OF THE PREFERRED EMBODIMENT

As shown in the accompanying drawings for purpose of illustration, the present invention resides in a scaffolding unit, generally referred to by the reference number 10, which is particularly adapted for use in constructing or repairing roof structures when floor or ceiling joists lie below.

With reference now to FIGS. 1–3, the scaffolding unit 10 is comprised of first and second legs 12 and 14 having crossbars 16 extending therebetween. The vertical legs 12 and 14 are adjustable in length. In the illustrated particularly preferred embodiment, each leg 12 or 14 comprises a main body 18 having a first and telescopically and slidably received within an upper first riser 20. A lower end of the main body 18 is also slidably connected to a lower riser 22. This enables the legs 12 and 14 to be adjusted to a desired height. The various segments of the legs 12 and 14 include apertures 24 therethrough which are alignable within one another to receive a locking pin 26 such as a cotter pin or the like. In this manner, the height of the legs 12 and 14 can be fixed in place.

The crossbars 16 are also adjustable in length, or width, so as to alter and provide adjustment to the width of the structure 10. With reference to FIGS. 1 and 3, each crossbar 16 is comprised of a tubular first segment 28 extending from one of the crossbars 12 or 14, and a smaller second segment 30 extending from the opposite leg 12 or 14. The second segment is telescopically and slidably received within the first segment 28 to provide width adjustment. The first and second segments 28 and 30 include alignable apertures 32 which receive a locking pin or the like to fix the relationship of the first and second segments 28 and 30 at the desired width.

To provide stability and strength, preferably, multiple crossbars 16 extend between the first and second legs 12 and 14, although as few as a single upper crossbar 16 may be utilized in accordance with the present invention. As shown in FIGS. 1 and 2, notches or slits 34 are formed in the upper riser 20 so that the upper riser 20 is lowered onto the main body 18 in a crossbar 16 extending between the main bodies 18 of the first and second legs 12 and 14 will be received within the slot 34. Similar slots 34 can be formed on either the main body 18 or lower riser 22 for the same purposes.

A foot 36 is pivotally attached to the bottom end of each leg 12 and 14. The foot 36 is a generally U-shaped member which is sized and configured such so as to be slipped over an exposed edge of the floor or ceiling joist. Such floor and ceiling joists are one to two inches in thickness, thus the foot 36 is sized so as to fit over such edge of the joist. The feet 36 are pivotally attached to the legs 12 and 14 so that a construction worker is not limited to positioning the scaffold unit 10 running parallel to the ceiling or floor joist, but rather can elect to set up the joist scaffold perpendicular to the joist. In use, two joist scaffold units 10 are set up so that they are spaced from one another. A plank, or the like, is placed on the upper crossbars 16 of each to provide a working and supportive surface for the construction workers.

It has been found that although the feet 36 prevent lateral movements of the joist scaffold units 10, forward or backward motion is still a possibility. Thus, the invention incorporates a vertical brace 38 which extends from either the legs 12 and 14 or crossbar 16 downwardly to a lower joist. The brace 38 includes an attachment means, such as the illustrated eyehook 40 which is received onto the legs 12 and 14 or braces 16. In a particularly preferred embodiment, the eyehook 40 is sufficiently large so as to be received on the crossbars 16 or ends of the upper riser 20 and extend diagonally therefrom to the joists. A joist foot 42 is pivotally attached to the brace 38 at an opposite end thereof. The joist foot 42 is also a generally a U-shaped member sized so as to be positioned over an exposed edge of a joist. The joist foot 42 includes an aperture 44 for receipt of a thumb screw or other fastener which can be inserted through the joist foot 42 and into contact with the joist so as to fix the joist foot in place.

In a particularly preferred embodiment the brace 38 is adjustable in length. The brace 38 is comprised of a first tube 46 which is hollow so as to slidably and telescopically receive a second tube or rod 48. Each tube 46 and 48 includes apertures 50 which are alignable with one another so as to receive a locking pin therethrough for fixing the length of the brace 38. Typically in use, a brace 38 will extend from each leg 12 or 14, or two braces 38 will extend from the crossbars 16 to provide a stable support for the construction worker.

A method of constructing the joist scaffolding unit 10 as described will now be provided. First, the main body 18 must be built. A 1"×3" square tubing having a length of 24" is provided. A 1"×1" square tubing having a length of 23" is welded thereto to form the first cross-bar segment 28. On the opposite main body 18, a ⅞"×⅞" square tubing having the length of 23 inches is welded thereto so as to be aligned with the first segment 28. This square tubing comprises the second segment 30 which is slidably received in the first segment 28. Holes, ½", are drilled through the crossbars 16 so as to accept a 7⁄16" pin. The lower riser is comprised of ⅞"×2⅞" square tubing having the length of approximately 28 inches. The crossbars 16 are formed generally in the same manner. The lower riser 22 can thus slide into the main body 18. Holes, ⅝", are drilled into the main body 18 and lower riser 22 to provide adjustment apertures. Thus, the lower riser 22 and main body 18 can be adjustably positioned from as little as 2' in height to as much as 4' in height. Slots 34 are created in the main body 18 as necessary to accommodate the lower riser 22 crossbar 16.

The top riser is comprised of 1⅛"×3⅛" square tubing having the length of approximately 32". The crossbar 16 is assembled in the same manner as the others, and preferably the top crossbar 16 is welded at approximately 4" below the top and bottom of the upper risers 20. This enables the supporting plank to have side stability when placed over the units 10. Notches or slots 34 are formed in the upper riser 20 so as to receive the crossbars 16 extending between the main body 18. Similar adjustment holes 24 are formed in the upper riser 20 so as to receive a pin 26 or the like through aligned apertures 24 of the various segments of the legs 12 and 14. The addition of the upper riser 20 enables the legs 12 and 14 to be raised approximately two more feet.

The feet 36 are then attached to the lower ends of the lower risers 22. The U-shaped feet are approximately 1½" in width. A hole is drilled therethrough and a pin or rivet type pin or bearing is used to connect to joist feet 36 to the lower riser 22 in a swivel-fashion.

Finally, the vertical brace 38 is created for stability. A 1¼" diameter round tube is provided which accepts a 1" iron rod or tube therethrough. Each segment is approximately 4' long. The ends of the tubes are capped, if necessary, and the eyehook 40 is attached at an upper end thereof. Preferably, the eye of the hook 40 must be large enough to slip over the crossbars 16. Holes of approximately ½" in diameter are drilled into the tubes 46 and 48. A joist foot 42 is attached to the lower end of the brace 38, as described above. An aperture 44 is drilled through the joist foot for receipt of a hand-tum bolt such as a wing nut or the like which is able to grip the wood joist. Typically, a piece of iron or metal is fitted around the crossbar 16 on the inside of each vertical brace 38 to insure that the vertical brace 38 does not slip from the its place. These are preferably removably attached for adjusting purposes.

Although an embodiment has been described in detail for purposes of illustration, various modifications may be made without departing from the scope and spirit of the invention.

What is claimed is:

1. A joist scaffold unit, comprising:

first and second vertical legs of adjustable length disposed generally parallel to one another;

horizontal crossbars of adjustable length extending between the first and second legs;

a foot pivotally attached to a bottom end of each leg, and configured to be secured to a ceiling or floor joist; and a brace of adjustable length extending from the lea or the crossbar at a first end thereof, and having a foot pivotally attached at an opposite end thereof configured to be secured to a ceiling or floor joist;

wherein the leg and brace feet each include a generally U-shaped bracket configured to receive a portion of a joist therein.

2. The scaffold unit of claim 1, including a fastener extendible through the foot and into contact with the joist to securely connect the foot thereto.

3. A joist scaffold unit, comprising:

first and second vertical legs of adjustable length disposed generally parallel to one another;

horizontal crossbars of adjustable length extending between the first and second legs;

a foot pivotally attached to a bottom end of each leg, and including a generally U-shaped bracket configured to receive a portion of a joist therein;

a fastener extendible through the foot and into contact with the joist to securely connect the foot thereto;

a brace of adjustable length extending from the leg or the crossbar at a first end thereof;

a foot pivotally attached at a second end of the brace and including a generally U-shaped bracket configured to receive a portion of a joist therein; and a fastener extendible through the brace foot and into contact with the joist to securely connect the brace foot thereto.

4. The scaffold unit of claim 3, wherein each leg comprises a main body having a first end telescopically and slidably received within an upper riser, and a second end telescopically and slidably received within a lower riser, the main body and upper and lower risers having alignable adjustment apertures for receipt of a locking pin.

5. The scaffold unit of claim 3, wherein each crossbar is comprised of a tubular first segment which telescopically and slidably receives a second segment, the first and second segments including alignable adjustment apertures for receipt of a locking pin therethrough.

6. The scaffold unit of claim 3, wherein the brace is comprised of a first tube that telescopically and slidably receives a second tube, the first and second tubes including alignable adjustment apertures for receipt of a locking pin therethrough.

7. A joist scaffold unit, comprising:

first and second vertical legs of adjustable length disposed generally parallel to one another, wherein each leg comprises a main body having a first end telescopically and slidably received within an upper riser, and a second end telescopically and slidably received within a lower riser, the main body and upper and lower risers having alignable adjustment apertures for receipt of a locking pin;

horizontal crossbars of adjustable length extending between the first and second legs, wherein each crossbar is comprised of a tubular first segment which telescopically and slidably receives a second segment, the first and second segments including alignable adjustment apertures for receipt of a locking pin therethrough;

a foot pivotally attached to a bottom end of each leg, and including a generally U-shaped bracket configured to receive a portion of a joist therein;

a fastener extendible through the foot and into contact with the joist to securely connect the foot thereto;

a brace of adjustable length extending from the leg or the crossbar at a first end thereof, wherein the brace is comprised of a first tube that telescopically and slidably receives a second tube, the first and second tubes including alignable adjustment apertures for receipt of a locking pin therethrough;

a foot pivotally attached at a second end of the brace and including a generally U-shaped bracket configured to receive a portion of a joist therein; and a fastener extendible through the brace foot and into contact with the joist to securely connect the brace foot thereto.

* * * * *